US006046655A

United States Patent [19]

Cipolla

[11] Patent Number: 6,046,655

[45] Date of Patent: Apr. 4, 2000

[54] ANTENNA FEED SYSTEM

[75] Inventor: Frank W. Cipolla, Newbury Park, Calif.

[73] Assignee: Datron/Transco Inc., Simi Valley, Calif.

[21] Appl. No.: 09/189,770

[22] Filed: Nov. 10, 1998

Related U.S. Application Data

[60] Provisional application No. 60/065,025, Nov. 10, 1997.

[51] Int. Cl.[7] ..... H01P 5/12; H01P 1/16

[52] U.S. Cl. ..... 333/137; 333/21 A

[58] Field of Search ..... 333/21 A, 125, 333/126, 135, 137; 343/756, 786

[56] References Cited

U.S. PATENT DOCUMENTS 4,710,734 12/1987 Sterns ..... 333/21 A X
5,304,999 4/1994 Roberts et al. ..... 333/21 A X

FOREIGN PATENT DOCUMENTS 518218 12/1992 European Pat. Off. ..... 333/21 A

*Primary Examiner*—Paul Gensler

[57] ABSTRACT

An antenna feed system provides reception of both circularly polarized signals and linearly polarized signals. An antenna is employed which is dual-circularly polarized and circularly polarized signals received thereby are separated into right and left hand components which are placed in phase quadrature relationship by means of a 90 degree hybrid coupler. Signals received by the antenna which have dual-orthogonal linear polarization are also separated into left and right hand components in quadrature relationship by means of a 90 degree hybrid coupler. A programmable phase shifter is utilized to set the orientation of the linearly polarized reception vector. A fixed delay line and an attenuator are provided for use in balancing the amplitude and phase of the right and left hand components of the linearly polarized signals.

4 Claims, 1 Drawing Sheet

ANTENNA FEED SYSTEM

This application claims benefit of Provisional Application Ser. No. 60/065,025, filed Nov. 10, 1997.

BACKGROUND OF THE INVENTION

1. Field of the Invention

This invention relates to antennas and more particularly to a system for transforming linearly polarized signals received by a circularly polarized antenna to proper form for detection.

2. Description of the Related Art

Antenna dishes generally in use provide reception of signals which have either dual circular polarization or dual linear polarization. To the best of Applicant's knowledge dishes or systems are not presently available which are capable of handling both types of polarization. Dual linearly polarized dishes must have their feed orientation rotated to match the angle of the linear polarization of the signals arriving from the source, usually a satellite. On moving vehicles, this problem is aggravated due to the fact that the platform on which the antenna is mounted often moves with respect to the incoming signal thus causing the feed polarization to become misaligned. This problem is not presented with dishes having circular polarization. Thus, there is an advantage to using circularly polarized dishes.

SUMMARY OF THE INVENTION

The device of the present invention enables the use of a circularly polarized antenna dish for the reception of both circularly or linearly polarized signals. Circularly polarized signals are processed in normal fashion by means of a 90 degree hybrid coupler to generate quadrature related left and right hand signal components. Linearly polarized signals are processed in this same manner by a 90 degree coupler to generate left and right hand signal components. The orientation of these signal components, however, depends on the relative phase delays of the transmission lines running between the antenna and the quadrature hybrid. This orientation is adjusted by means of a programmable phase shifter and an adjustable attenuator which can be set as needed.

It is therefore an object of this invention to provide a simple system for enabling a single circularly polarized dish antenna to receive and provide output signals having either circular or linear polarization.

It is a further object of this invention to obviate orientation problems encountered with linearly polarized dish antennas.

Other objects of the invention will become apparent from the following description taken in connection with the accompanying drawings.

DESCRIPTION OF THE DRAWINGS

The sole FIGURE is a functional block diagram of the system of the invention.

DETAILED DESCRIPTION OF THE INVENTION

Figure 1:
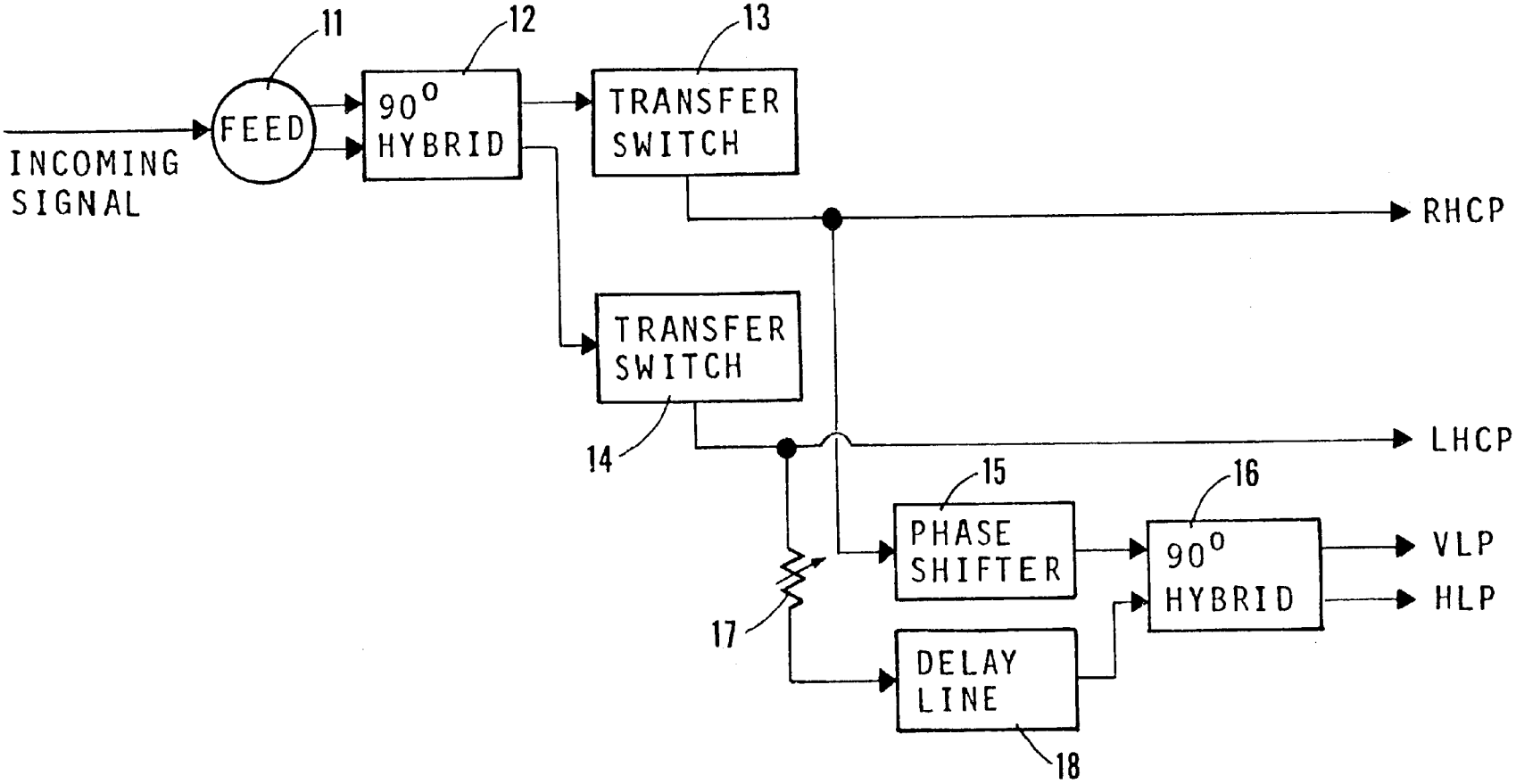

Referring now to the sole FIGURE, the system of the invention is schematically illustrated.

Feed 11 comprises the output feed of a conventional dual-orthogonal circularly polarized antenna having a right hand circularly polarized component(RHCP) and a left hand circularly polarized component(LHCP). The output of feed 11 is fed to 90 degree hybrid 12 which divides the signals into two equal parts and places them in phase quadrature relationship, thereby recovering the signals contained in the original two polarizations. Such hybrid couplers are well known in the art and are commercially available from Anaren Microwave Components, Syracuse, N.Y., and Sage Labs, Natick, N.H. among other suppliers. Anaren model no. 1J0770-3 has been found to operate quite satisfactorily.

The two quadrature related outputs of 90 degree hybrid coupler 12 are fed to transfer switches 13 and 14 respectively. Transfer switches 13 and 14 are two way switches which normally feed the signals from hybrid 12 which are right hand and left hand circularly polarized signals directly through as inputs to the receiver. When switches 13 and 14 are actuated, usually by remote control, the right and left hand circularly polarized signals are fed through to phase shifter 15 and attenuator 17, respectively. Phase shifter 15 is set, usually remotely, to select the orientation of the linearly polarized reception vector, as may be desired. Phase shifter 15 is commercially available from various sources including Vectronics in Middlesex, N.J. (model no.DP6711.7-360) and Arra, Inc. in Bay Shore, N.Y. The output of attenuator 17 is fed to delay line 18. The attenuator and delay line are adjusted to balance, or equalize, the amplitude and phase between the two signals, after phase shifter 15 is set to provide the desired orientation for the linearly polarized reception vector.

The outputs of phase shifter 15 and delay line 18 are fed to 90 degree hybrid 16. This is a hybrid coupler similar to hybrid 12 which divides the signal into two equal parts and places these two parts in quadrature relationship, thereby recovering the original linearly polarized signals. The vertical left hand polarized signal(VLP) and horizontal left hand polarized signal(HLP) are then fed to the receiver.

It is to be noted that while this system has been described in connection with receiving signals, it can also be adapted for use in connection with transmitted signals.

While the invention has been described and illustrated in detail it is to be understand that this is intended by way of illustration and example only, the scope of the invention being limited by the terms of the following claims.

I claim:

1. A system for enabling the detection of linearly polarized signals received by a circularly polarized antenna comprising:

a first ninety degree hybrid coupler;

feed means for separately feeding right and left hand polarized components of the signals received by said antenna to said hybrid coupler;

said hybrid coupler dividing the signals into two equal parts and placing said parts in quadrature relationship with each other, said quadrature related parts comprising two separate output signals of said coupler;

a phase shifter;

an attenuator;

a delay line connected to said attenuator; and a second ninety degree hybrid coupler;

the phase shifter receiving one output signal and being programmed to set the linear orientation of the linearly polarized reception vector; the attenuator and delay line receiving the other output signal and being set to balance the amplitude and phase between the signal fed to the attenuator and the signal fed to the phase shifter;

the outputs of said phase shifter and said delay line being fed to said second hybrid coupler, said second hybrid coupler dividing said signals into equal parts which are in quadrature relationship, said quadrature related signals comprising vertically and horizontally linearly polarized outputs corresponding to linearly polarized incoming signals.

2. A system for enabling the detection of both circularly and linearly polarized signals received by a circularly polarized antenna comprising:

a first ninety degree hybrid coupler;

feed means for separately feeding right and left hand polarized components of the signals received by the antenna to said first hybrid coupler;

said first hybrid coupler dividing the signals into two equal parts and placing said parts in quadrature relationship with each other, said quadrature related parts providing two separate output signals of said coupler;

a phase shifter;

an attenuator;

a delay line connected to said attenuator;

first and second two way transfer switches, said switches each receiving one of the output signals of said hybrid coupler and being operable to either feed the signals fed thereto as right and left hand circularly polarized outputs or to feed one of said signals to said attenuator and the other of said signals to said phase shifter;

and a second ninety degree hybrid coupler;

the phase shifter being programmed to set the linear orientation of the linearly polarized reception vector; the attenuator and delay line being set to balance the amplitude and phase between the signal fed to the attenuator and the signal fed to said phase shifter;

the outputs of said phase shifter and said delay line being fed to said second hybrid coupler, said second hybrid coupler dividing said signals into equal parts which are in quadrature relationship, said quadrature related signals being vertically and horizontally linearly polarized outputs in accordance with linearly polarized incoming signals.

3. A method for enabling the detection of linearly polarized signals received by a circularly polarized antenna having left and right hand polarized components comprising the steps of:

dividing the left and right hand signal components into two equal signals and placing said signals in quadrature relationship with each other;

phase shifting one of said two signals to set the linear orientation of the linearly polarized reception vector;

attenuating and delaying the other of said two signals to balance the amplitude and phase relationship between the two signals; and dividing said signals into equal parts which are in quadrature relationship with each other, said quadrature related signals being vertically and horizontally linearly polarized corresponding to the linearly polarized received by the antenna.

4. The method of claim 3 wherein the delaying and attenuation of the other of said two signals is done remotely.

* * * * *